US007167661B2

(12) United States Patent
Hatakeyama et al.

(10) Patent No.: US 7,167,661 B2
(45) Date of Patent: Jan. 23, 2007

(54) SENSOR CLEANING MECHANISM FOR IMAGE FORMING DEVICE

(75) Inventors: Chisato Hatakeyama, Osaka (JP); Takatoshi Nishimura, Osaka (JP); Shinji Yoshinaga, Osaka (JP); Masakazu Uehara, Osaka (JP); Hiromichi Ninomiya, Yokohama (JP)

(73) Assignee: Kyocera Mita Corporation, Osaka (JP)

( * ) Notice: Subject to any disclaimer, the term of this patent is extended or adjusted under 35 U.S.C. 154(b) by 138 days.

(21) Appl. No.: 10/904,247

(22) Filed: Oct. 31, 2004

(65) Prior Publication Data

US 2005/0095027 A1 May 5, 2005

(30) Foreign Application Priority Data

Oct. 31, 2003 (JP) ..... 2003-372218
Nov. 14, 2003 (JP) ..... 2003-384886

(51) Int. Cl.
*G03G 21/00* (2006.01)

(52) U.S. Cl. ..... 399/98

(58) Field of Classification Search ..... 399/60, 399/81, 98, 107, 110, 111, 121, 301
See application file for complete search history.

(56) References Cited

U.S. PATENT DOCUMENTS 6,219,508 B1 * 4/2001 Nagatomi et al. ..... 399/301 X
6,463,236 B2 * 10/2002 Morikami et al. ..... 399/121
6,704,523 B2 * 3/2004 Takeuchi et al. ..... 399/81 X
6,975,821 B2 * 12/2005 Suzuki et al. ..... 399/107

FOREIGN PATENT DOCUMENTS

JP 02-240666 * 9/1990
JP A-H06-3878 1/1994

* cited by examiner

*Primary Examiner*—Sandra L. Brase
(74) *Attorney, Agent, or Firm*—Global IP Counselors, LLP

(57) ABSTRACT

A sensor cleaning mechanism is arranged on a transport/transfer belt unit having a photosensor mounted thereon. The transport/transfer belt unit is detachably arranged on a main body of an image forming device. The sensor cleaning mechanism includes a cleaning arm that is pivotably mounted on a frame of the transport/transfer belt unit, and a cleaning member that is arranged on the cleaning arm and capable of cleaning the surface of the photosensor. With the transport/transfer belt unit mounted in the main body of the image forming device, the cleaning member of the cleaning arm will placed in a stowed position away from the surface of the photosensor, and when a user removes the transport/transfer belt unit from the main portion of the image forming device, the cleaning member of the cleaning arm will pivot to a position that covers the surface of the photosensor and cleans the same.

12 Claims, 7 Drawing Sheets

SENSOR CLEANING MECHANISM FOR IMAGE FORMING DEVICE

BACKGROUND OF THE INVENTION

1. Field of the Invention

The present invention relates to a sensor cleaning mechanism, and more particularly to a cleaning mechanism arranged on a function unit that is detachable with respect to a main body of an image forming device, and which serves to clean a photosensor mounted on the function unit.

In addition, the present invention relates to a sensor cleaning control device, and more particularly to a photosensor cleaning control device of an image forming device having a function unit that is detachable with respect to a main body of the image forming device, and which cleans a photosensor by means of a cleaning mechanism that uses the act of installing and removing the function unit.

2. Background Information

A photosensor is arranged in an image forming device such as a copying machine, printer, and the like in order to detect image density, registration, and the like. This photosensor is either arranged on the main body of the image forming device, or is arranged on a unit that is detachably mounted on the main body of the image forming device.

This type of photosensor includes a translucent detection surface, but if toner or other foreign matter becomes adhered to the detection surface, detectability will deteriorate, normal detection values will no longer be obtained, and thus accurate control can no longer be performed.

Accordingly, mechanisms for cleaning the detection surface of photosensors have been proposed in the past. For example, in the device shown in Japanese Unexamined Patent Application No. H06-3878, a photosensitive unit, an electrostatic charger, a developer and a cleaner are unitized to form a process cartridge, and this process cartridge is detachable with respect to the main body of the device. A photosensor that detects the toner density on the photosensitive unit is installed on the main body of the device, and when the process cartridge is installed or removed, a cleaning member that is attached to the casing of the process cartridge will come into contact with the surface of the photosensor so as to clean the surface thereof.

Conventional photosensor cleaning mechanisms are designed to clean a photosensor attached to the main body of a device with a cleaning member arranged on a unit that is detachable with respect to the main body of the device. In other words, the photosensor is arranged on a fixed main body of the device, and the cleaning member is arranged on a movable unit.

However, when the photosensor is disposed in the rear of the device main body, the cleaning member on the unit may not come into contact with the photosensor when installing or removing the unit due to the position in which the photosensor is disposed. In addition, in order to bring the photosensor into contact with the cleaning member, it will be necessary to handle the device main body and the unit will a high decree of precision when the unit is installed in or removed from the device main body, and the guide members used to install and remove the unit must be highly precise so that there is no play when the unit is installed or removed.

Furthermore, the situation described above is also true with the reverse configuration, in which the photosensor is installed on the detachable unit. In other words, when the photosensor is disposed on the rear of the unit, the cleaning member arranged on the device main body cannot come into contact with the photosensor. In addition, the positional relationship of both must be managed with a high degree of precision.

In the conventional mechanisms described above, in which the photosensor and the cleaning member are arranged on a fixed portion (the device main body) and a movable portion (the unit), and which clean the surface of the photosensor by bringing the photosensor and the cleaning member into contact with each other when the movable portion is installed and removed, cleaning may not be performed due to the position of the photosensor, and the positional relationship of the photosensor and the cleaning member must be managed with a high degree of precision.

In addition, the photosensor cleaning mechanism disclosed in the prior art reference noted above is designed to clean the surface of the photosensor when the process cartridge is installed or removed. Because of this, the surface of the photosensor will not be cleaned so long as the process cartridge is not installed or removed. One could install and remove the process cartridge periodically in order to clean the process cartridge. However this type of task is easy to forget, and thus the surface of the photosensor may not be cleaned for a long period of time, and accurate control of the image forming device will not be possible.

In addition, the installation and removal of a function unit such as the process cartridge is normally carried out when a paper jam occurs near the function unit. However, because image forming devices are designed so that paper jams occur as infrequently as possible, the installation and removal of the function unit may not occur for a long period of time.

SUMMARY OF THE INVENTION

An object of the present invention is to make it possible to easily clean a photosensor of an image forming device without regard to the position of the photosensor, and without requiring a high degree of precision during assembly and installation.

Another object of the present invention is to reliably clean a photosensor in an image forming device that is designed to use the installation and removal of a function unit to clean the surface of the photosensor.

A sensor cleaning mechanism for an image forming device according to the present invention is a mechanism for cleaning a photosensor. The sensor cleaning mechanism is arranged on a function unit that is detachably arranged on a main body of the image forming device, and the function unit has a photosensor mounted thereon. The sensor cleaning mechanism includes a cleaning arm that is pivotably mounted on the function unit, and a cleaning member that is arranged on the cleaning arm and capable of cleaning the surface of the photosensor. With the function unit mounted in the main body of the image forming device, the cleaning member of the cleaning arm will move to a stowed position away from the surface of the photosensor. When the function unit is removed from the main portion of the image forming device, the cleaning member of the cleaning arm will slide across the surface of the photosensor and clean the photosensor.

Here, the function unit is defined as an object in which a plurality of elements which function to form images have been unitized. In the present invention, the function unit can be installed in or removed from the main body of the image forming device as a single unit.

With this mechanism, the detection surface of the photosensor will be cleaned by means of the cleaning member when the function unit is installed in or removed from the main body of the image forming device. More specifically, the cleaning arm is pivotably mounted on the function unit, and the cleaning member is arranged on the cleaning arm. When the function unit is installed in the main body of the image forming device, the cleaning member is placed in a stowed position away from the surface of the photosensor. When the function unit is removed from the main body of the image forming device, or when the function unit is installed the main body of the image forming device, the cleaning arm will pivot in accordance with the installation/removal operation, and the cleaning member will slide along the surface of the photosensor in order to clean the surface of the photosensor.

Because the photosensor and the cleaning member are both arranged on the function unit, cleaning can be performed even if the photosensor is disposed on the rear of the function unit. In addition, compared to conventional structures, it will no longer be necessary for the positional relationship of the photosensor and the cleaning member to have a particularly high degree of precision.

In the aforementioned mechanism, it is preferred that the cleaning arm be positioned so that the cleaning member covers the surface of the photosensor when the function unit is removed from the main body of the image forming device.

Here, there is no need for the photosensor to be used when the function unit is removed from the main body of the image forming device. Accordingly, the cleaning member will cover the photosensor in this situation. Thus, if there is no need to use the photosensor, the cleaning member can prevent foreign material and the like from adhering to the photosensor.

In the aforementioned mechanism, it is preferable that the function unit further include a drive arm that is pivotably arranged on the function unit, and which causes the cleaning arm to pivot in response to the installation and removal of the function unit. One end of the drive arm is capable of contacting a portion of the main body of the image forming device, and the other end thereof has a pivot center of the cleaning arm interposed between the other end and the cleaning member and contacts a side of the cleaning arm that is opposite the side on which the cleaning member is arranged.

Here, the drive arm will pivot in response to the installation and removal of the function unit, which in turn will cause the cleaning arm to pivot. In other words, because the cleaning member will pivot by means of two arms, the pivot distance of the cleaning member can be easily lengthened compared to when only one arm is used. In addition, even if the direction in which the function unit is installed and removed is different than the direction in which the cleaning member is to be pivoted, this situation can be dealt with by appropriately setting the direction in which the two arms are attached.

In the aforementioned mechanism, it is preferable that the pivot plane of the cleaning arm and the drive arm be different. As noted above, even if the direction in which the function unit is installed and removed is different than the direction in which the cleaning member is to be pivoted, this situation can be dealt with because the direction in which the two arms are attached, i.e., the pivot planes thereof, are different.

In the aforementioned mechanism, it is preferable that the direction in which the cleaning arm extends is different from the direction in which the drive arm extends. When the direction in which both arms extend is the same, a large space will be needed in the direction in which the arms extend. However, because the directions in which both arms extend are different in the present invention, the movement distance of the cleaning member can be lengthened in a narrow space.

In the aforementioned mechanism, it is preferable that the photosensor detect at least one of image density and registration, and the function unit is a transport/transfer belt unit or a transfer belt unit. The photosensor that is mounted on the transport/transfer belt unit must face the transport/transfer belt. If a shutter member for preventing the contamination of the photosensor is provided, a drive mechanism therefor will be required, and thus the structure of the image forming device will become more complex. In addition, even if a shutter member is provided, there is still the possibility that toner and the like will adhere to the photosensor when the photosensor is in use. Even in this situation, the present invention will allow cleaning to be easily performed by means of the cleaning mechanism. Note that the present invention can also be used to clean a photosensor mounted on a transfer belt unit.

A photosensor cleaning control device of an image forming device according to the present invention is a device that serves to clean the surface of a photosensor by means of a cleaning mechanism that operates by installing and removing a detachable function unit from a main portion of the image forming device. The photosensor cleaning control device includes an installation/removal detection sensor that detects the installation and removal of the function unit, operational state detection means that detects the operational state of the image forming device, and notification means that notifies a user that the function unit must be removed and re-installed based upon the detection results of the installation/removal sensor and the operational state detection means.

Here, the installation/removal detection sensor and the operational state detection means will detect whether the function unit is continuously mounted in the main portion of the image forming device, and what the operational state is while the function unit is mounted therein. Based upon these detection results, a user will be notified that the function unit should be removed and re-installed. This notification will allow a user to easily confirm that the time to clean the photosensor has arrived, and will prevent a user from forgetting to clean the photosensor.

In the aforementioned device, it is preferable that the operational state detection means of the image forming device detect the number of pages printed by the image forming device after the installation/removal detection sensor detects that the function unit has been mounted, and the notification means notify a user that the function unit must be removed and re-installed when the number of pages printed is equal to or greater than a predetermined number of pages.

The image forming device is provided with a mechanism that will count the number of pages printed. Thus, if this count value is used to detect the operational state, there will no need to provide a separate mechanism for detecting the operational state.

In the aforementioned device, it is preferred that the function unit includes a driven member and a motor that drives the driven member, and the operational state detection means measures the motor drive time while the function unit is continuously mounted in the main body of the image forming device. The notification means will notify a user that the function unit must be removed and re-installed when the motor drive time is equal to or greater than a predetermined time.

Because the operation time (motor drive time) of the function unit while the function unit is continuously mounted in the main body of the image forming device is the operational state thereof, a more precise photosensor cleaning time can be known.

In the aforementioned device, it is preferable that the image forming device include a display unit that serves to display messages, and the notification means display messages on the display unit that request a user to remove and re-install the function unit.

Because a message that requests a user to remove and re-install the function unit is displayed on the display unit on, for example, an operation panel, a user can be more easily made aware of the cleaning time, and can be reliably prevented from forgetting to clean the photosensor.

In the aforementioned device, it is preferable that the device further include operation prevention means that will prevent the operation of the image forming device when the notification means has displayed the message.

When the photosensor cleaning time has arrived, this fact will be displayed on the display unit and image formation will be prevented. This can prevent images having a poor image quality from being formed.

In the aforementioned device, it is preferable that the photosensor and the cleaning mechanism be arranged on the function unit.

Conventional photosensor cleaning mechanisms are designed to clean the photosensor attached to the main body of the image forming device with a cleaning member arranged on a unit that is detachable with respect to the main body of the device. In other words, the photosensor is arranged on a fixed main body of the device, and the cleaning member is arranged on a movable unit.

However, when the photosensor is disposed in the rear of the device main body, the cleaning member on the unit may not come into contact with the photosensor when installing or removing the unit due to the position in which the photosensor is disposed. In addition, in order to bring the photosensor into contact with the cleaning member, it will be necessary to handle the device main body and the unit with a high decree of precision when the unit is installed in or removed from the device main body, and the guide members for attaching and detaching the unit must be highly precise so that there is no play when the unit is attached or detached.

Accordingly, in a preferred aspect of the present invention, the photosensor and the cleaning mechanism are arranged on the function unit. Because of this, cleaning can be performed even if the photosensor is disposed on the rear of the function unit. In addition, compared to conventional structures, it will no longer be necessary for the positional relationship of the photosensor and the cleaning member to have a particularly high degree of precision.

In the aforementioned device, it is preferable that the photosensor detect at least one of image density and registration, and the function unit is a transport/transfer belt unit or a transfer belt unit.

If an image forming unit that includes a photosensitive drum (a process cartridge) is used as the function unit, the possibility that the photosensitive drum will be exposed to light will increase when the function unit is removed solely for cleaning, and this will shorten the service life of the photosensitive drum. In addition, removing the image forming unit will not be easy for a user.

Accordingly, in a preferred aspect of the present invention, the function unit will have few problems even during installation and removal, and will be a transport/transfer belt unit or a transfer belt unit that is easy for user to install and remove.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

1. First Embodiment

Overall Configuration

Figure 1:
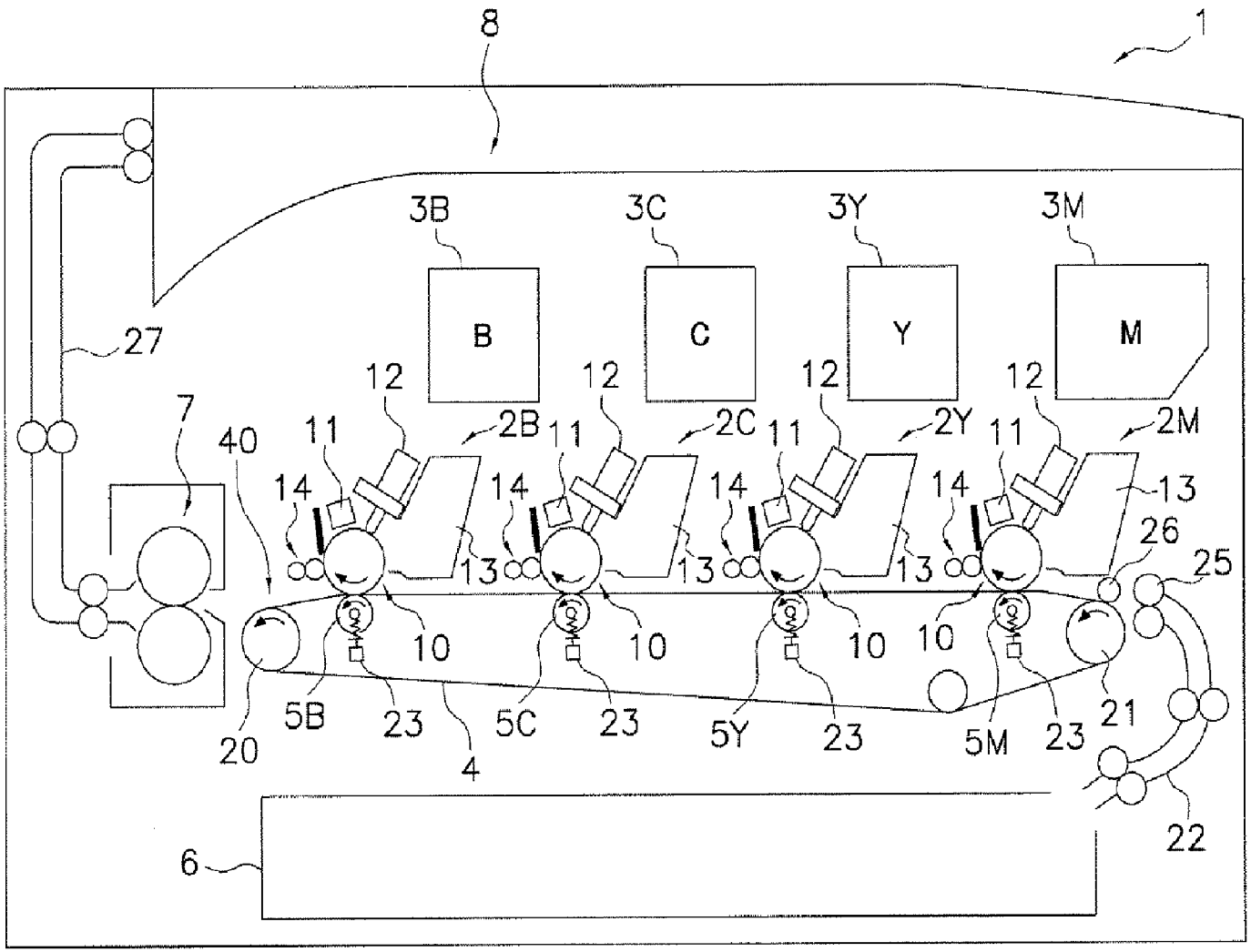
FIG. 1 is a schematic cross-sectional view of a color printer in which an embodiment of the present invention is adopted.

FIG. 1 shows a schematic cross-section of a tandem type color printer in which a sensor cleaning mechanism according to a first embodiment of the present invention is adopted. The color printer 1 includes color image forming units 2M, 2Y, 2C, 2B that serve to form color images, color toner containers 3M, 3Y, 3C, 3B, a transport/transfer belt that transports paper used as transfer media, first to fourth transfer rollers 5M, 5Y, 5C, 5B that serve to transfer color toner images to paper transported thereto, a paper supply mechanism 6 that supplies paper to the image forming units 2M, 2Y, 2C, 2B, a fixing unit 7 that serves to fix toner images transferred onto the paper, and a discharge unit 8.

The image forming units 2M, 2Y, 2C, 2B are sequentially disposed from the upstream side in the paper transport direction, respectively form magenta, yellow, cyan, and black toner images, and are aligned in the horizontal direction along the transport/transfer belt 4. The image forming units 2M, 2Y, 2C, 2B respectively include a photosensitive drum 10 having a photosensitive layer composed of amorphous silicon or the like, and an electrostatic unit 11, an exposure unit 12, a developing device 13, and a drum cleaning mechanism 14 are sequentially disposed around the periphery of each photosensitive drum 10.

The transport/transfer belt 4 spans across and is circularly driven between a drive roller 20 and a driven roller 21. Paper that has been transported from the paper supply mechanism 6 via a paper supply path 22 adheres to the transport/transfer belt 4, and is transported thereby in a generally horizontal direction. The first to fourth transfer rollers 5M–5B are disposed so as to face each photosensitive drum 10 of the image forming unit via the transport/transfer belt 4, and can move between an upper transfer position and a lower release position by means of respective solenoids 23. In other words, in the transfer position, the transfer rollers are moved upward, and the paper on top of the transport/transfer belt 4 is brought into contact with the photosensitive drums 10. In the release position, the transfer rollers are moved downward, and the paper on top of the transport/transfer belt 4 is separated from the photosensitive drums 10.

Here, the transport/transfer belt 4, the drive roller 20, the driven roller 21, the first to fourth rollers 5M–5B and the solenoids 23 are unitized as a transport/transfer belt unit 40, and the entire transport/transfer belt unit 40 can be installed into and removed from the main body of the color printer 1 (hereinafter referred to as the device main body).

Note that the first to fourth transfer rollers 5M–5B are disposed at the same height, but the drive roller 20 and the driven roller 21 are disposed in positions that are lower than the positions of the first to fourth transfer rollers 5M to 5B. Because of this, the transport/transfer belt 4 is maintained in a generally horizontal state and circulates between the first to fourth transfer rollers 5M–5B.

The paper supply path 22 is formed from a guide member that guides paper transport and a plurality of roller pairs. A pair of resist rollers 25 that serve to synchronize the formation of toner images and the transport of paper are arranged on the furthest upstream side of the paper supply path 22. An attachment roller 26 that serves to apply an adherence bias voltage to the edge of the paper or to the entire surface thereof in order to adhere the paper to the transport/transfer belt 4 is arranged between the pair of resist rollers 25 and the first transfer roller 5M. In this example, the adherence roller 26 is disposed above and opposite to the driven roller 21.

The fixing unit 7 includes a heating roller having a heater in the interior thereof, and a pressure roller that is pushed toward the heating roller. A paper discharge path 27 is arranged between the fixing unit 7 and the discharge unit 8. Like the paper supply path 22, the paper discharge path 27 is formed from a guide member and a plurality of roller pairs. Note that the discharge unit 8 is formed on the upper surface of the color printer 1, and the paper that passed through the fixing unit 7 is transported upward via the paper discharge path 7 and discharged to the upper surface of the color printer 1.

Transport/Transfer Belt Unit

A description will be provided below of a transport/transfer belt (one function unit) to which the present invention has been applied.

Figure 2:
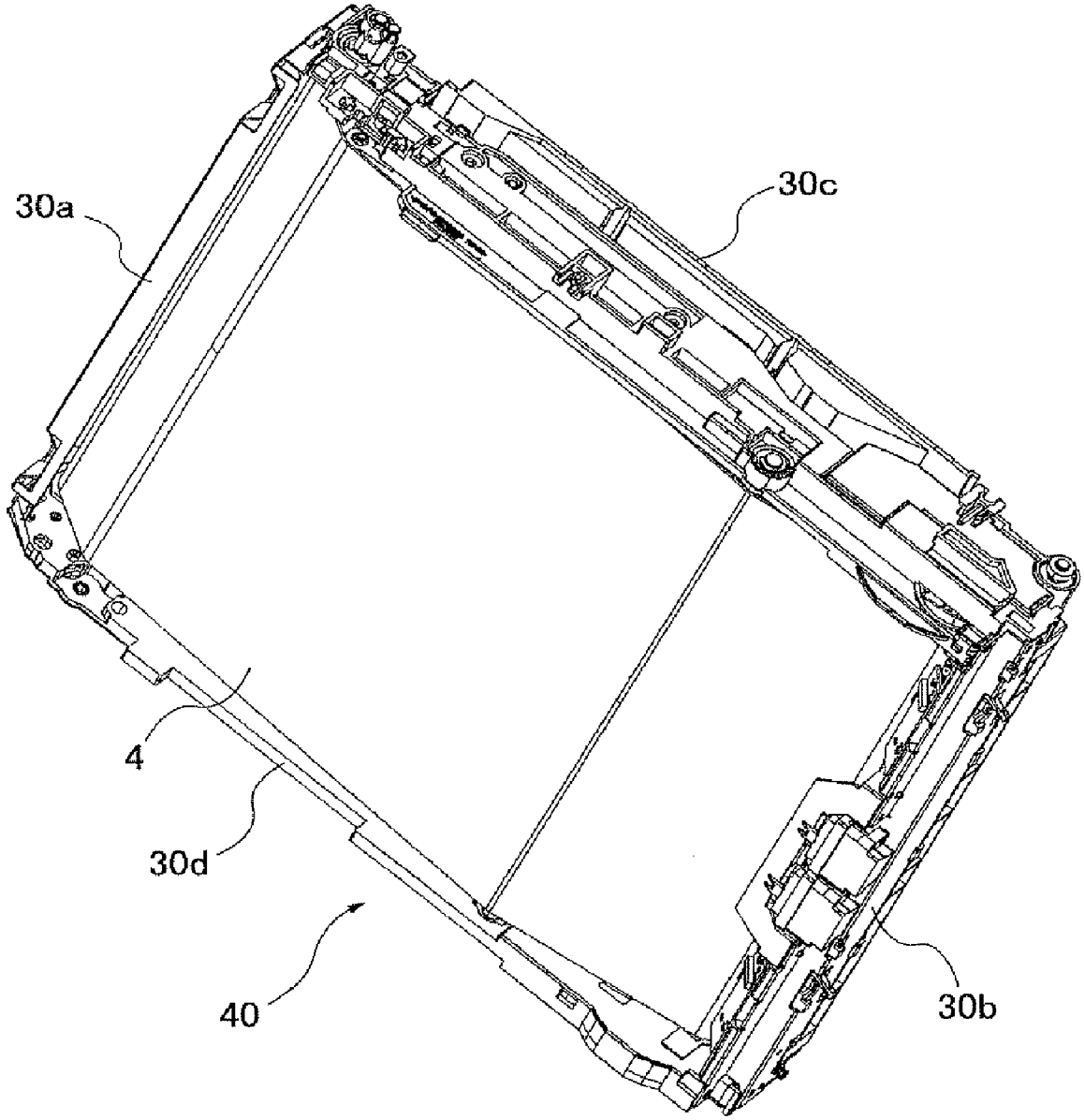
FIG. 2 is an oblique view of transport/transfer belt of the color printer shown in FIG. 1.

The transport/transfer belt unit 40 can be installed and removed in the state shown in FIG. 2. Note that FIG. 2 is a view of the transport/transfer belt when viewed from the lower surface thereof. The transport/transfer belt unit 40 includes frames 30*a*, 30*b*, 30*c*, and 30*d* on four sides thereof, and each roller that forms the unit is supported by the frames 30*c*, 30*d*. The frame 30*a* is positioned on the paper supply transport path 22 side, the frame 30*b* is positioned on the fixing unit 7 side, the frame 30*c* is positioned on the rear side of the device, and the frame 30*d* is positioned on the front side of the device.

Figure 3:
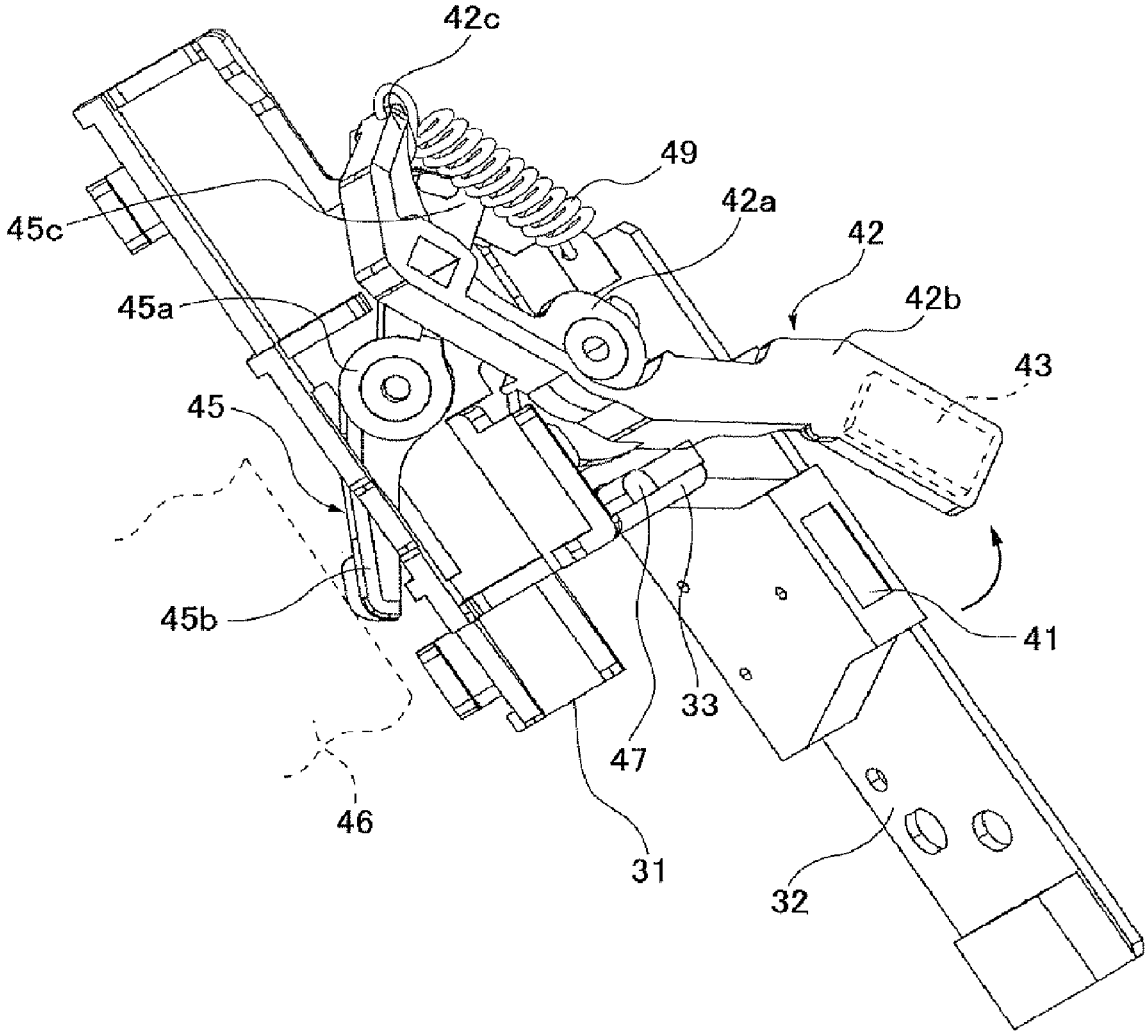
FIG. 3 is an oblique view of a photosensor and a sensor cleaning mechanism arranged on the transport/transfer belt shown in FIG. 2.
Figure 4:
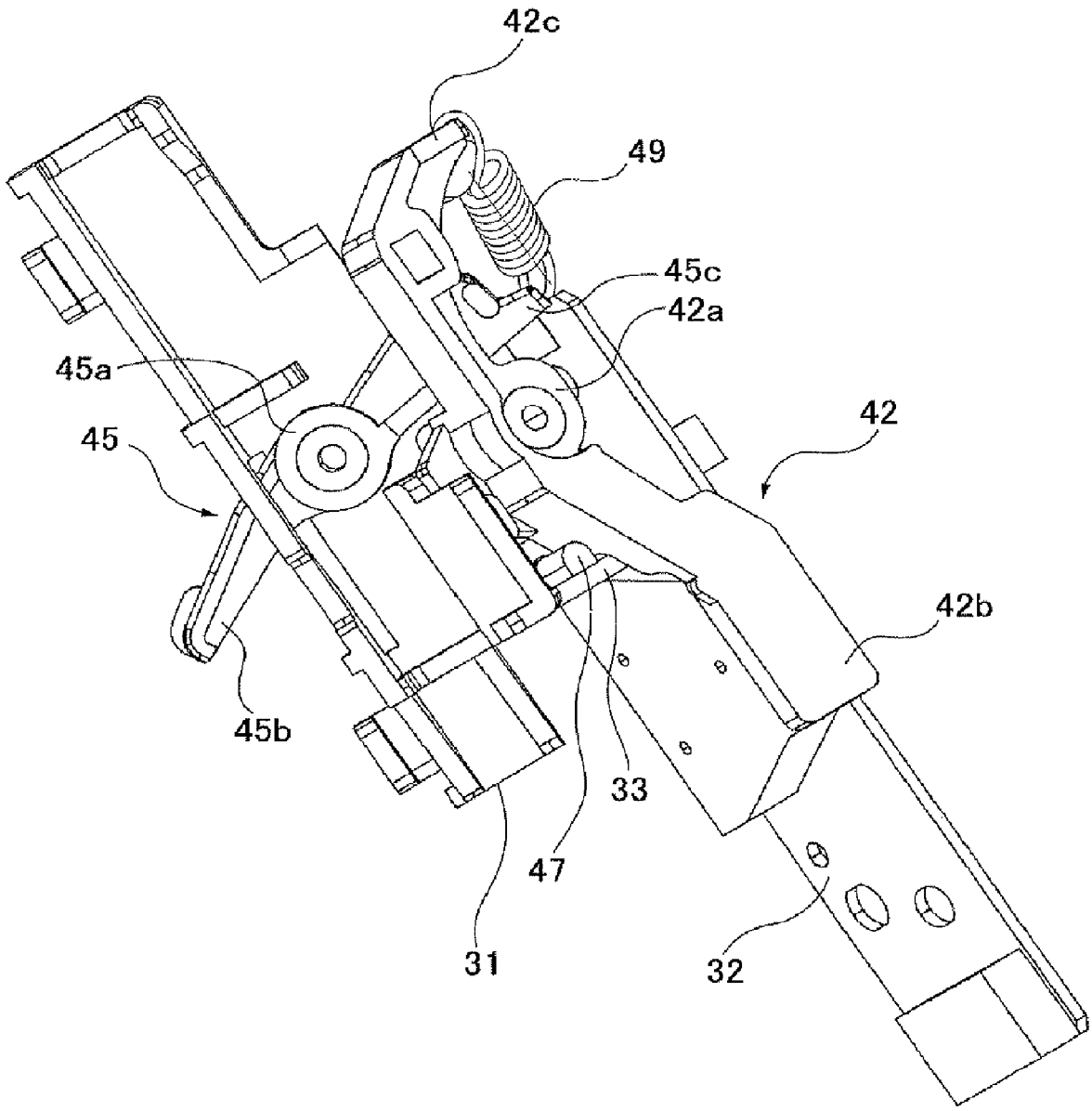
FIG. 4 is another oblique view of the photosensor and the sensor cleaning mechanism arranged on the transport/transfer belt shown in FIG. 2.

A photosensor 41 that serves to detect image density and registration is mounted on the frame 30*b* of the transport/transfer belt unit 40. The photosensor 41 and a sensor cleaning mechanism are shown in FIGS. 3 and 4. FIGS. 3 and 4 show a portion of the frame 30*b* of the transport/transfer belt unit 40. FIG. 3 shows the transport/transfer belt unit 40 when installed in the device main body, and FIG. 4 shows the transport/transfer belt unit 40 when removed from the device main body.

The photosensor 41 is a reflecting sensor, and is fixed to a portion of an installation member 32 that is attached perpendicular to the frame 30*b* (not shown in FIGS. 3 and 4). The photosensor 41 shines light in a horizontal direction (in FIG. 1) toward the transport/transfer belt 4 rotated by the drive roller 20, and employs light reflected from an image formed on the transport/transfer belt 4 used to detect image density and registration (deviation in the positions of each color). The photosensor 41 is employed in order to control, within an appropriate range, the registration and image density of images formed on paper transported by means of the transport/transfer belt 40.

In addition, a cleaning arm 42 is pivotably mounted on the installation member 32. The cleaning arm 42 includes a central pivot portion 42*a* in the approximate center thereof in the longitudinal direction, a cleaning portion 42*b* that is formed on one side of the central pivot portion 42*a*, and an operative portion 42*c* that is formed on the other side of the central pivot portion 42*a*. A hole is formed in the central pivot portion 42*a*, and a shaft formed on the installation member 32 is fitted into this hole to form a pivot center. A cleaning member 43 composed of felt or the like is fixed to the lower surface of the cleaning portion 42*b*. The cleaning member 43 is sized so as to be capable of contacting the surface of the photosensor 41, and capable of covering the entire surface of the photosensor 41. Note that an installation member 31 is arranged on the frame 30*b* to be parallel with the installation member 32, and a linking member 33 that connects the installation members 31, 32 is arranged therebetween.

A drive arm 45 is pivotably mounted on the installation member 31 near the cleaning arm 42. The drive arm 45 includes a central pivot portion 45*a* in the approximate center thereof in the longitudinal direction, a contact portion 45*b* that is formed on one side of the central pivot portion 45*a* and which extends outward (toward the fixing unit 7), and an engagement portion 45*c* that is formed on the other side of the central pivot portion 42*a* and which extends inward. A hole is formed in the central pivot portion 45*a*, and a shaft formed on the installation member 31 that is installed on the frame 30*b* is fitted into this hole to form a pivot center. In addition, as shown in FIG. 3, the contact portion 45*b* is disposed so that the tip thereof will spring out from an opening formed in the frame 30*b* (not shown in FIGS. 3, 4) to the exterior of the unit, and this tip can come into contact with a frame 46 on the device main body when the unit is installed in the device main body. Furthermore, the tip of the engagement portion 45*c* is in contact with a curved lateral surface of the operative portion 42*c* of the cleaning arm 42.

As described above, the cleaning arm 42 is configured so as to pivot in a plane that is parallel with the surface of the photosensor 41, and the drive arm 45 is configured so as to pivot in a plane that is different than that of the cleaning arm 42. In addition, the directions in which the two arms extend are mutually different.

Note that a spring 49 that urges the cleaning arm 42 in the clockwise direction in FIGS. 3 and 4 is mounted between the tip of the operative portion 42*c* of the cleaning arm 42 and the installation member 32. In addition, a stopper 47 that comes into contact with the lateral surface of the cleaning portion 42*b* of the cleaning arm 42, and limits the pivot of the cleaning arm 42 in the clockwise direction, is arranged on the linking member 33 that links the installation member 31 and the installation member 32. When the transport/transfer belt unit 40 is removed from the device main body, each arm 42, 45 will be placed into the positions shown in FIG. 4 by means of the urging force of the spring 49 and the stopper 47. In these positions, the cleaning member 43 fixed to the cleaning portion 42*b* of the cleaning arm 42 will be in contact with the surface of the photosensor 41, and will cover the entire surface thereof.

Control Block

Figure 5:
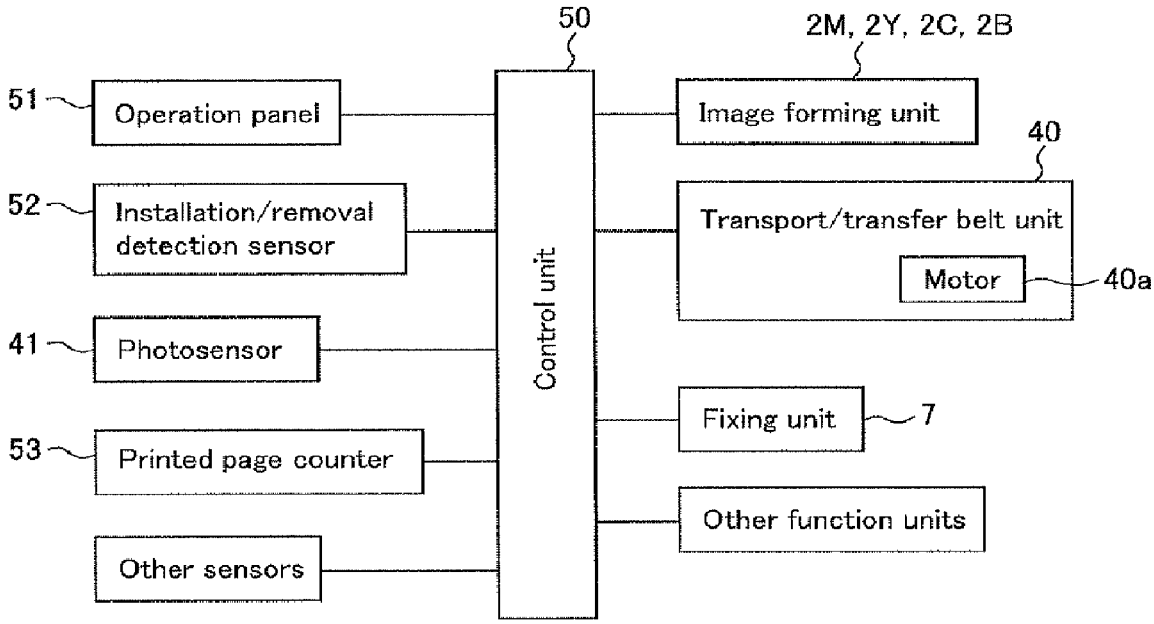
FIG. 5 is a control block diagram of the color printer shown in FIG. 1.

As shown in FIG. 5, the color printer 1 includes a control unit 50. The control unit 50 is a microcomputer that includes a CPU, ROM, RAM, and the like. The control unit 50 is connected to an operation panel 51 that includes a display unit, an installation/removal detection sensor 52 that serves to detect whether or not the transport/transfer belt unit 40 is mounted in the color printer 1 (i.e., whether or not the transport/transfer belt unit 40 is removed therefrom), the photosensor 41, and a counter 53 that counts the number of pages which have been printed. The installation/removal detection sensor 52 can be formed with a limit switch or the like that turns on and off in response to the installation and removal of the transport/transfer belt 40. In addition, the control unit 50 is connected to the image forming units 2M, 2Y, 2C, 2B that include the photosensitive drums, the transport/transfer belt unit 40 that includes a motor 40*a* that serves to rotationally drive the drive roller 20, the fixing unit 7, and other sensors and function units.

Image Formation Operation

Next, the image formation operation will be briefly described.

First, a color mode that forms color images on paper will be described. When print data is send from a computer to the color printer 1, the print data is apportioned to image data for each color by the control unit 50 and appropriately processed, and is then send to the exposure unit 12. The surface of the photosensitive drums 10 are electrostatically charged by means of the electrostatic unit 11, and electrostatic latent images are formed on the surfaces of the photosensitive drums 10 by mean of the exposure the photosensitive drums 10 in accordance with the image data from the exposure unit 12. The electrostatic latent images formed on the surface of the photosensitive drums 10 are developed by means of the developing device 13, and toner images of each color are formed.

Paper is supplied from the paper supply mechanism 6 via the paper supply path 22, but that paper will be temporarily stopped by the pair of resist rollers 25. The pair of resist rollers 25 are driven so that they match the timing at which the aforementioned toner images are formed, and an adherence bias voltage is applied to the edge of the paper by means of the attachment roller 26. This paper is adhered to the transport/transfer belt 4 and sequentially passed between the photosensitive drums 10 for each color and the first to fourth transfer rollers 5M, 5Y, 5C, and 5B, and toner images corresponding to each color will be overlaid onto and transferred to the paper in order to form color toner images thereon. Then the color toner image on the paper will be fixed by the application of heat and pressure when the paper passes through the fixing unit 7, and the paper will be discharged to the discharge unit 8 via the paper discharge path 27.

In a monochrome mode which forms monochrome images, an adherence bias voltage will be applied by the attachment roller 26 to the entire surface of paper transported from the paper supply mechanism 6 via the paper supply path 22. In addition, in the monochrome mode, the first to third transfer rollers 5M, 5Y, and 5C will be lowered to the release position by means of the solenoids. Thus, paper transported by the transport/transfer belt 4 will not come into contact with the photosensitive drums 10 other than the photosensitive drum 10 associated with the black toner, and only a black toner image will be transferred from the black photosensitive drum 10. Other operations in the monochrome mode are the same as those in the color mode.

Sensor Cleaning Operation

First, as shown in FIG. 3, the tip of the operational portion 45*b* of the drive arm 45 is in contact with the frame 46 of the device main body when the transport/transfer belt unit 40 is installed in the device main body. Thus, the engagement portion 45*c* of the drive arm 45 is pivoted in the counter-clockwise direction. Because the operational portion 42*c* of the cleaning arm 42 is in contact with the engagement portion 45*c*, the cleaning arm 42 resists the urging force of the spring 49 and pivots counter-clockwise in FIG. 3 around the central pivot portion 42*a*. Because of this, the cleaning portion 42*b* of the cleaning arm 42 (i.e., the cleaning member 43) will be moved to a position that does not cover the surface of the photosensor 41. In this state, the cleaning arm 42 will not obstruct the detection of image density and registration.

Next, the contact portion 45*b* of the drive arm 45 will separate from the frame 46 of the device main body when the transport/transfer belt unit 40 is removed from the device main body. Thus, because the restriction with respect to the cleaning arm 43 of the drive arm 45 will be released, the cleaning arm 42 will pivot clockwise by means of the urging force of the spring 49 mounted on the cleaning arm 42. Then, the lateral surface of the cleaning portion 42*b* of the cleaning arm 42 will come into contact with the stopper 47, and will stop in the position shown in FIG. 4.

In addition, when the transport/transfer belt unit 40 is to be mounted in the device main body, the contact portion 45*b* of the drive arm 45 will come into contact with the frame 46 of the device main body when the transport/transfer belt unit 40 advances into the device. When the transport/transfer belt unit 40 is pushed further into the device main body in this state, the contact portion 45*b* of the drive arm 45 will pivot counter-clockwise. When this occurs, the operative portion 42*c* of the cleaning arm 42 that is in contact with the engagement portion 45*c* of the drive arm 45 will pivot counter-clockwise, and thus the cleaning portion 45*b* will pivot counter-clockwise. Then, with the transport/transfer belt unit 40 installed in the device main body as shown in FIG. 3, the cleaning portion 42*b* will be moved away from the surface of the photosensor 41.

During the installation and removal operations described above, the cleaning member 43 will move into contact with the surface of the photosensor 41 as the cleaning arm 42 pivots. The surface of the photosensor 41 will be cleaned by means of the movement of the cleaning member 43.

Sensor Cleaning Control

Figure 6:
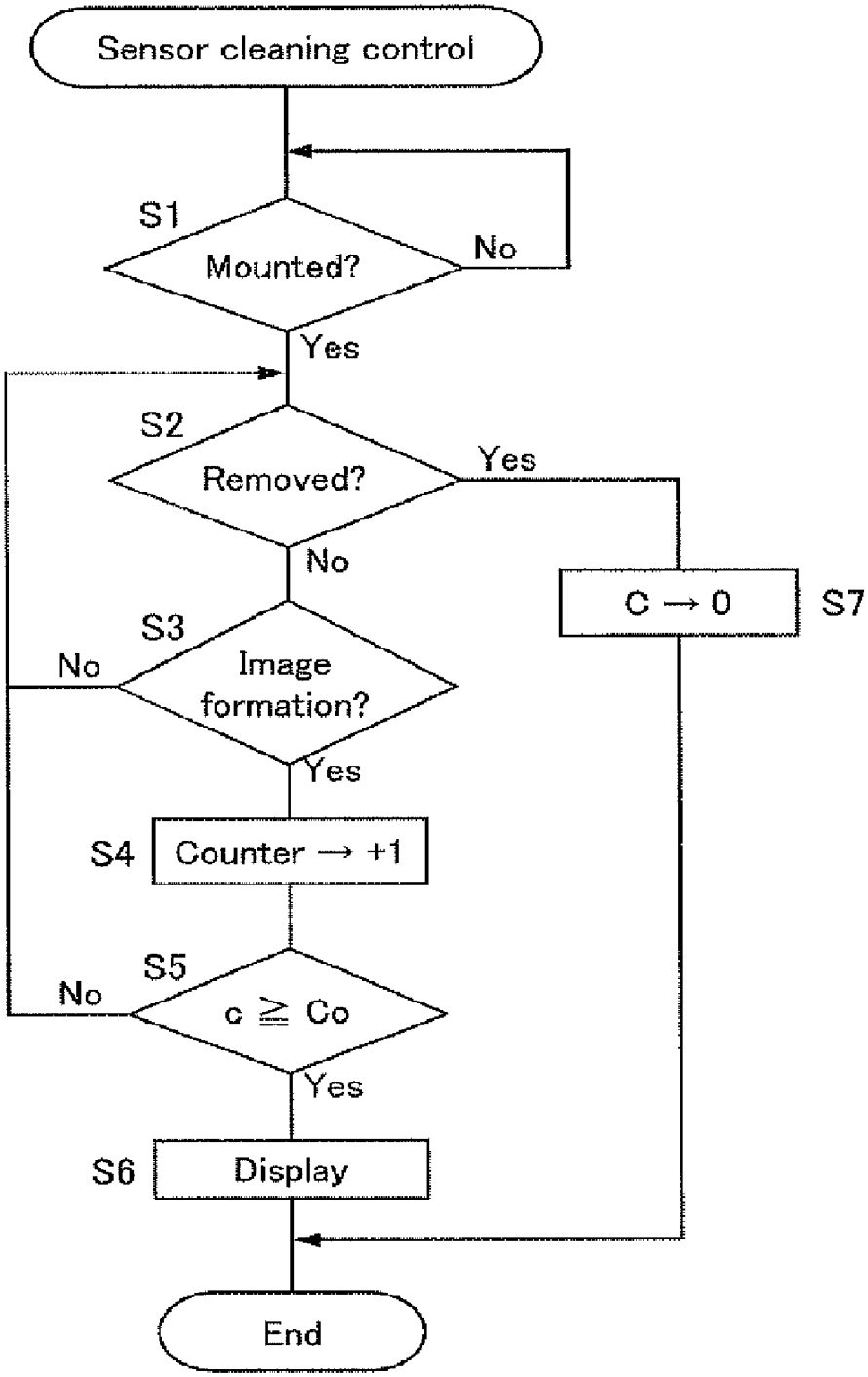
FIG. 6 is a flowchart for a photosensor cleaning control process in the color printer shown in FIG. 1 according to a first embodiment of the present invention.

Next, the flowchart shown in FIG. 6 will be used to describe a sensor cleaning control process. First, in Step S1, it will be determined whether or not the transport/transfer belt unit 40 is mounted in the device main portion. If the transport/transfer belt unit 40 is mounted in the device main portion, the routine will move from Step S1 to Step S2. In Step S2, it will be determined whether or not the transport/transfer belt unit 40 has been removed from the device main portion. If the transport/transfer belt unit 40 is mounted therein, and image formation is to be executed, the routine will move from Step S2 to Step S4 via Step S3. In Step S4, a count value c of the counter 53 will be incremented upward by 1.

In Step S5, it will be determined whether or not the count value c is equal to or greater than a predetermined limit count value $C_0$. The limit count value $C_0$ indicates when cleaning is to occur. For example, if a paper jam occurs at the rate of 1 page in every 1000 pages printed, the transport/transfer belt unit 40 will be removed from the color printer 1 after 1000 pages have been printed, and thus $C_0$ will be set to 1000.

Step S2 to Step S5 will be repeatedly executed until the count value c is equal to or greater than the limit count value of 1000. When the count value c is equal to or greater than the limit count value $C_0$, the routine will move from Step S5 to Step S6, and for example the message "Time to clean the sensor. Please remove and re-install the transport/transfer belt unit." will be displayed on the display unit of the operation panel. Note that while this display is being performed, it is also possible for image formation to be prohibited until the transport/transfer belt unit 40 is removed and re-installed so that the cleaning of the sensor is performed without fail. This additional feature will reliably maintain image quality. Note also that if the count value c reaches the limit count value $C_0$ during a print job, the prohibition against further image formation will be performed after the completion of the print job.

In addition, when the transport/transfer belt unit 40 mounted in the device main portion is removed, the determination in Step S2 will be "Yes", and the routine will move to Step S7. In Step S7, the count value c up to that point will be reset to zero.

Note that because the count value c serves to detect the operational state of the color printer 1, the count value c will be reset to zero when the transport/transfer belt unit 40 is removed. However, in prior art devices, the count value of the total number of pages printed will not be reset.

In the embodiment described above, because the photosensor 41 and the cleaning member 43 are arranged on the transport/transfer belt 40, the photosensor 41 can be cleaned even if it is disposed on the rear of the unit. In addition, for the same reason, the placement and assembly precision of the photosensor 41 and the cleaning member 43 need not be strictly managed, and the surface of the photosensor 41 can be reliably cleaned. In other words, because the photosensor is assembled together with a cleaning mechanism on one member, the positional relationship of both can be easily made highly precise, and cleaning can be reliably performed.

In addition, because two arms 42, 45 are employed, and the directions in which the two arms extend differ in order to move the cleaning member 43, the two arms 42, 45 can maintain a long movement distance in a narrow space, and thus more reliable cleaning can be performed, compared to when the cleaning member is moved by means of one arm. Furthermore, because two arms are used, and the pivot planes of the two arms are different, the photosensor 41 can be reliably cleaned even if the direction in which the transport/transfer belt 40 is installed and removed is different from the direction in which the surface of the photosensor 41 is cleaned. In addition, because each arm 42, 45 is mounted onto a shaft formed on the attachment members 31, 32, screws and the like are unnecessary and the structure will be simplified.

In addition, in the event that the transport/transfer belt unit 40 is not removed and re-installed, i.e., the photosensor 41 has not been cleaned, and the number of printed pages has reached or exceeded a predetermined number of pages, a message that requests the transport/transfer belt unit 40 be removed and re-installed in order to clean the photosensor 41 will be displayed on the display unit of the operation panel. Thus, a user can be easily and reliably notified that the photosensor 41 must be cleaned. This will prevent the user from forgetting to clean the photosensor 41.

2. Second Embodiment

In the first embodiment, the number of pages printed are counted in order to detect the operational state. However, a more accurate determination of the operational state may be provided by detecting the drive time of the motor 40*a* that drives the drive roller 20 of the transport/transfer belt unit 40. The reason for this is because in a color printer like that of the present embodiment, images for image density correction and/or registration correction are formed in addition to the images that are to be transferred to paper. Thus, if the frequency at which these images are to be formed is high, there will be a strong possibility that toner and the like produced by the formation of these images will contaminate the photosensor.

Note that in the second embodiment, because only the sensor cleaning control is different compared to the first embodiment, only the different components will be described below.

Sensor Cleaning Control

Figure 7:
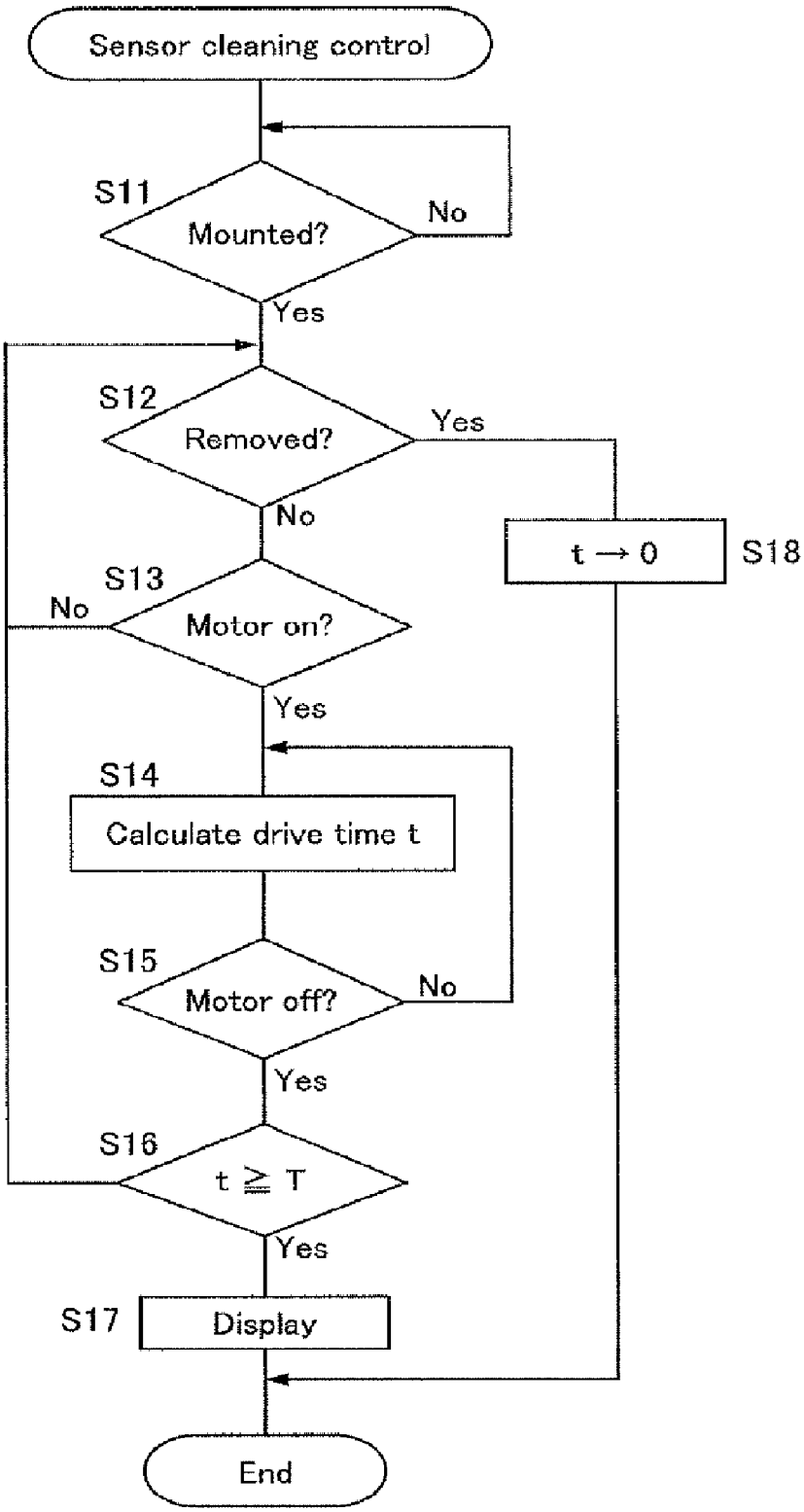
FIG. 7 is a flowchart for a photosensor cleaning control process in the color printer shown in FIG. 2 according to a second embodiment of the present invention.

As shown in FIG. 7, in Step S11, it will be determined whether or not the transport/transfer belt unit 40 is mounted in the device main portion. If the transport/transfer belt unit 40 is mounted in the device main portion, the routine will move from Step S11 to Step S12. In Step S12, it will be determined whether or not the transport/transfer belt unit 40 has been removed from the device main portion. If the motor 40*a* that drives the drive roller 20 is being driven with the transport/transfer belt unit 40 in the mounted state, the routine will move from Step S12 to Step S14 via Step S13. In Step S14, the drive time t of the drive roller 20 will be calculated. This calculation is performed by sequentially reading the drive time into the RAM in the control unit 50.

Next, in Step S15, it will be determined whether or not the rotation of the motor 40*a* is stopped. The drive time t will continue to be calculated in Step S14 until the motor 40*a* is stopped. If the motor 40*a* has stopped, the routine will move from Step S15 to Step S16. In Step S16, it will be determined whether or not the drive time t of the motor 40*a* is equal to or greater than a predetermined cleaning time T of the photosensor 41. For example, if a paper jam occurs once in every 1000 pages printed, i.e., if the transport/transfer belt unit 40 is removed once every 1000 pages, and if the motor 40*a* of the drive roller 20 is driven 20 seconds in order to print one page, then the cleaning time T will be 20,000 seconds (approximately 5.5 hours).

Step S12 to Step S16 will repeatedly execute until the drive time t is equal to or greater than the cleaning time T. When the drive time t is equal to or greater than the cleaning time T, the routine will move from Step S16 to Step S17, and for example the message "Time to clean the sensor. Please remove and re-install the transport/transfer belt unit." will be displayed on the display unit of the operation panel. Note that like in the first embodiment, while this display is being performed, it is also possible for image formation to be prohibited until the transport/transfer belt unit 40 is removed and re-installed so that the cleaning of the sensor is performed without fail. This additional feature will reliably maintain image quality. Note also that if the drive time t reaches the cleaning time T during a print job, the prohibition against further image formation will be performed after the completion of the print job.

In addition, when the transport/transfer belt unit 40 mounted in the color printer 1 is removed, the determination in Step S12 will be "Yes", and the routine will move to Step S18. In Step S18, the drive time t up to that point will be reset to zero.

Note that as an alternate means of detecting the operational state, the drive time of the motors that drive the photosensitive drums, developing rollers, or the like may be calculated, in accordance with the location in which the photosensor is disposed.

In the aforementioned embodiment, in the event that the transport/transfer belt unit 40 is not removed and re-installed, i.e., the photosensor 41 has not been cleaned, and the calculated drive time T of the drive roller 20 has reached or exceeded a predetermined use time (cleaning time) T, a message that requests the transport/transfer belt unit 40 be removed and re-installed in order to clean the photosensor 41 will be displayed on the display unit of the operation panel. Thus, a user can be easily and reliably notified that the photosensor 41 must be cleaned. This will prevent the user from forgetting to clean the photosensor 41. Thus, a user can be easily and reliably notified that the photosensor 41 must be cleaned. This will prevent the user from forgetting to clean the photosensor 41.

Other Embodiments

In the aforementioned embodiments, a transport/transfer belt was used as an example of a function unit. However, the present invention can be applied in the same way to another function unit, such as a process cartridge that includes a photosensitive drum or the like, a transfer belt, or other devices.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A sensor cleaning mechanism for cleaning a photosensor arranged on a function unit that is detachable with respect to an image forming device, the sensor cleaning mechanism comprising:

a cleaning arm that is pivotably mounted on the function unit; and a cleaning member that is arranged on the cleaning arm and capable of cleaning a surface of the photosensor;

wherein the cleaning member of the cleaning arm will be placed in a stowed position away from the surface of the photosensor when the function unit is mounted in the main body of the image forming device, and the cleaning member of the cleaning arm will slide across the surface of the photosensor and clean the same when the function unit is removed from the main portion of the image forming device.

2. The sensor cleaning mechanism set forth in claim 1, wherein the cleaning arm is placed in a position so that the cleaning member covers the surface of the photosensor when the function unit is removed from the main body of the image forming device.

3. The sensor cleaning mechanism set forth in claim 1, wherein the function unit further comprises a drive arm that is pivotably arranged on the function unit, and causes the cleaning arm to pivot in accordance with the installation and removal of the function unit;

wherein one end of the drive arm is capable of coming into contact with a portion of the main body of the image forming device, and another end of the drive arm contacts a side of the cleaning arm that is opposite the side on which the cleaning member is arranged.

4. The sensor cleaning mechanism set forth in claim 3, wherein the cleaning arm and the drive arm pivot in different planes.

5. The sensor cleaning mechanism set forth in claim 4, wherein the cleaning arm extends in a direction different from that of the drive arm.

6. The cleaning mechanism set forth in claim 1, wherein the photosensor detects at least one of image density and registration; and the function unit is a transport/transfer belt unit or a transfer belt unit.

7. A sensor cleaning control device of an image forming device that serves to clean a surface of a photosensor with a cleaning mechanism that operates by installing and removing a detachable function unit from a main body of the image forming device, the sensor cleaning control device comprising:

an installation/removal detection sensor that detects installation and removal of the function unit;

an operational state detection unit that detects an operational state of the image forming device; and a notification unit that notifies a user of the image forming device that the function unit must be removed and re-installed, based upon data from the installation/removal sensor and the operational state detection unit;

wherein the photosensor detects at least one of image density and registration; and the function unit is a transport/transfer belt unit or a transfer belt unit.

8. The sensor cleaning control device set forth in claim 7, wherein the operational state detection unit detects a number of pages printed by the image forming device after the installation/removal detection sensor detects that the function unit has been mounted; and the notification unit notifies a user that the function unit must be removed and re-installed when the number of pages printed is equal to or greater than a predetermined number of pages.

9. The sensor cleaning control device set forth in claim 7, wherein the function unit comprises a driven member and a motor that drives the driven member;

the operational state detection unit measures a motor drive time while the function unit is continuously mounted in the main body of the image forming device; and the notification unit will notify a user that the function unit must be removed and re-installed when the motor drive time is equal to or greater than a predetermined time.

10. The sensor cleaning control device set forth in claim 7, wherein the image forming device comprises a display unit that serves to display messages; and the notification unit displays a message on the display unit that requests a user to remove and re-install the function unit.

11. The sensor cleaning control device set forth in claim 10, wherein the sensor cleaning control device further comprises an operation prevention unit that will prevent operation of the image forming device when the notification unit has displayed the message.

12. The sensor cleaning control device set forth in claim 7, wherein the photosensor and the cleaning mechanism are arranged on the function unit.

* * * * *